US011439552B1

(12) United States Patent
Murr

(10) Patent No.: US 11,439,552 B1
(45) Date of Patent: Sep. 13, 2022

(54) APPARATUS FOR SUPPORTING AND LIFTING A PERSON IN A SEATED POSITION

(71) Applicant: Eugene Murr, Springfield, OR (US)

(72) Inventor: Eugene Murr, Springfield, OR (US)

( * ) Notice: Subject to any disclaimer, the term of this patent is extended or adjusted under 35 U.S.C. 154(b) by 0 days.

(21) Appl. No.: 17/476,341

(22) Filed: Sep. 15, 2021

(51) Int. Cl.
*A61G 7/10* (2006.01)

(52) U.S. Cl.
CPC ..... *A61G 7/1055* (2013.01); *A61G 7/1038* (2013.01); *A61G 7/1059* (2013.01)

(58) Field of Classification Search
CPC ... A61G 7/1038; A61G 7/1055; A61G 7/1059
See application file for complete search history.

(56) References Cited

U.S. PATENT DOCUMENTS 1,288,397 A * 12/1918 Eberile ..... A47D 13/105 297/274
1,740,949 A * 12/1929 Luery ..... A47D 13/105 297/274
1,971,294 A 8/1934 Bunker
2,167,794 A * 8/1939 Bentz ..... A47D 13/105 297/277
3,859,677 A * 1/1975 Nordwig ..... A61G 1/00 5/89.1
4,075,719 A * 2/1978 Sullivan ..... A61G 7/1044 5/87.1
4,202,063 A * 5/1980 Murray ..... A61G 7/1059 5/87.1
4,232,412 A * 11/1980 Petrini ..... A61G 7/1076 5/83.1
4,693,512 A 9/1987 Hobson
4,964,182 A * 10/1990 Schmerler ..... A61G 7/10 5/81.1 R
7,328,467 B2 2/2008 Aarestad
9,107,789 B2 8/2015 Brandorff et al.
10,631,647 B1 4/2020 Wu et al.
2013/0175836 A1* 7/2013 Chen ..... A47C 4/18 297/354.1

FOREIGN PATENT DOCUMENTS

CA 1266449 A * 3/1990 ..... A61G 7/1023
DE 8131985.1 5/1982
FR 457267 A * 9/1913
GB 789468 1/1958
GB 813618 5/1959
WO WO-2004062546 A1 * 7/2004 ..... A61G 7/1015

* cited by examiner

*Primary Examiner* — David R Hare
*Assistant Examiner* — Alexis Felix Lopez
(74) *Attorney, Agent, or Firm* — David S. Alavi

(57) ABSTRACT

A frame includes a left upright member with a longitudinal open-ended tube at its lower end, a right upright member with a longitudinal open-ended tube at its lower end, and cross member(s) connecting together the upright members in a transversely spaced-apart arrangement wide enough to straddle a person's thighs or hips between the left and right tubes. A sheet of flexible material has left and right pairs of collinear sleeves, with gaps therebetween, attached to lower portions of corresponding left and right edges of the sheet. Left and right rods inserted through the corresponding sleeves, and through the corresponding tubes in the gaps between the sleeves, and attachment of an upper portion of the sheet to an upper portion of the frame, form an upright seat for supporting and lifting a person.

27 Claims, 8 Drawing Sheets

APPARATUS FOR SUPPORTING AND LIFTING A PERSON IN A SEATED POSITION

FIELD OF THE INVENTION

The field of the present invention relates to patient lift or transfer devices. In particular, apparatus and methods are disclosed for supporting and lifting a person in a seated position, e.g., for being lifted or transferred.

BACKGROUND

Some previous examples of a patient lift or transfer devices are disclosed in:

- U.S. Pat. No. 1,971,294 entitled "Invalid handling device" issued Aug. 21, 1934 to Bunker;
- GB 789,468 entitled "Apparatus for lifting invalids" issued Jan. 22, 1958 to Watson et al;
- GB 813,618 entitled "A sling seat" issued May 21, 1959 to Priestman et al;
- DE 8131985.1 issued May 13, 1982 to Schallerer et al;
- U.S. Pat. No. 4,693,512 entitled "Swing seat unit" issued Sep. 15, 1987 to Hobson;
- U.S. Pat. No. 7,328,467 entitled "Patient lift and transfer device" issued Feb. 12, 2008 to Aarestad;
- U.S. Pat. No. 9,107,789 entitled "Invalid toileting safety sling" issued Aug. 18, 2015 to Brandorff et al; and
- U.S. Pat. No. 10,631,647 entitled "Foldable hanging chair" issued Apr. 28, 2020 to Wu et al.

SUMMARY

An inventive apparatus for supporting and lifting a person comprises a rigid frame, a flexible sheet, and a pair of rigid rods. The rigid frame including (i) a left upright member, (ii) an open-ended left tube attached to a bottom end of the left upright member in a longitudinal arrangement, (iii) a right upright member, (iv) an open-ended right tube attached to a bottom end of the right upright member in a longitudinal arrangement, and (v) one or more cross members connecting together the left and right upright members in a transversely spaced-apart arrangement. The frame is sufficiently wide to straddle thighs or hips of the person between the left and right tubes. The sheet of flexible material has (i) top, bottom, left side, and right side edges, (ii) a pair of collinear left sleeves attached to a lower portion of the left edge with a gap therebetween at least as long as a length of the left tube, and (iii) a pair of collinear right sleeves attached to a lower portion of the right edge with a gap therebetween at least as long as a length of the right tube. An upper portion of the sheet and corresponding upper portions of the left and right side edges extend beyond the pairs of left and right sleeves toward the top edge of the sheet; a lower portion of the sheet is at least as wide between the left and right sleeves as distance between the left and right tubes. A left rod of the pair is longer than the left tube and can be inserted through the left tube and at least partly through the left sleeves; a right rod of the pair is longer than the right tube can be inserted through the right tube and at least partly through the right sleeves. One or both of an upper portion of the frame or the upper portion of the sheet is structurally arranged so as to enable attachment of the upper portion of the sheet to, and detachment of the upper portion of the sheet from, the upper portion of the frame.

With: (i) the left tube positioned in the gap between the left sleeves, and the left rod positioned through the left tube and at least partly within both of the left sleeves; (ii) the right tube positioned in the gap between the right sleeves, and the right rod positioned through the right tube and at least partly within both of the right sleeves; and (iii) the upper portion of the sheet attached to the upper portion of the frame, the sheet forms a support for the person. The lower portion of the sheet forms a horizontal seat portion of the support, and the upper portion of the sheet forms an upright back portion of the support.

Objects and advantages pertaining to patient support or lift apparatus may become apparent upon referring to the example embodiments illustrated in the drawings and disclosed in the following written description or appended claims.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Figure 1B:
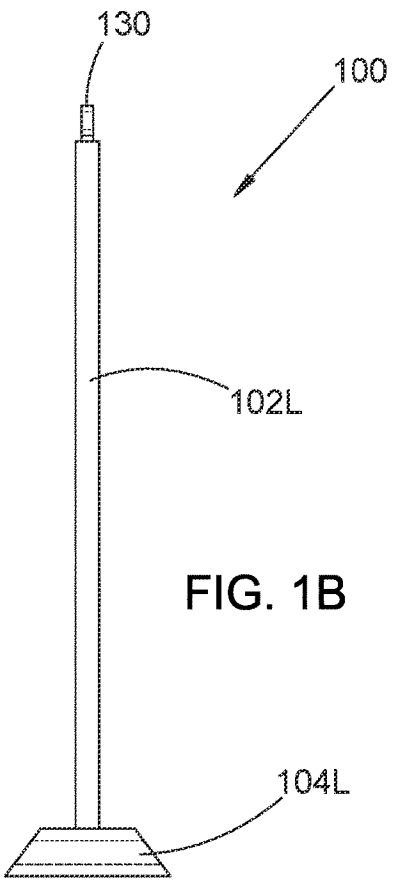
FIGS. 1A through 1D are front, side, top, and isometric views of a frame of an example inventive apparatus.
Figure 1C:
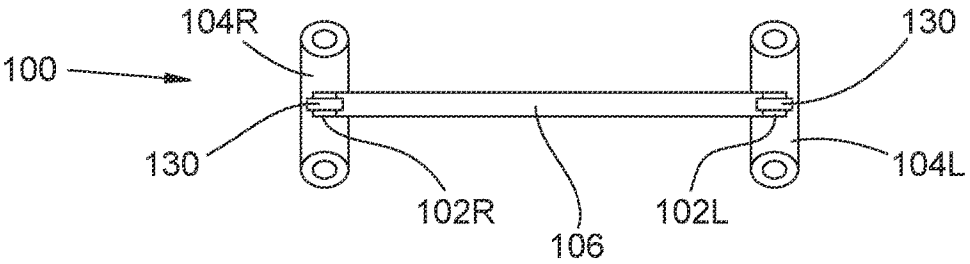
Figure 1A:
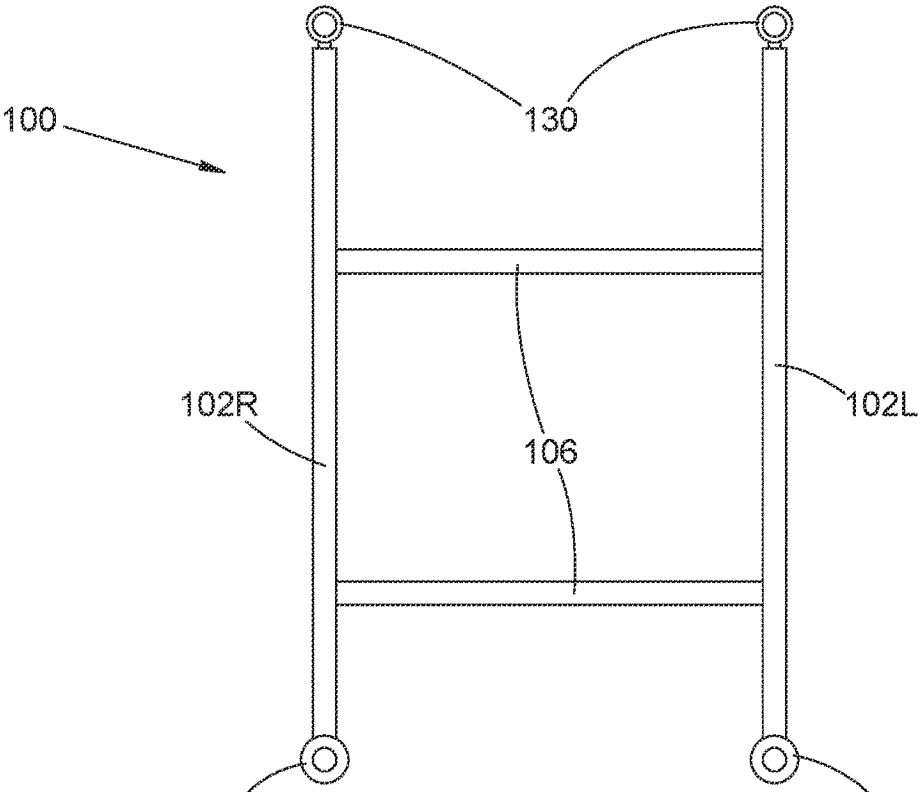
Figure 2:
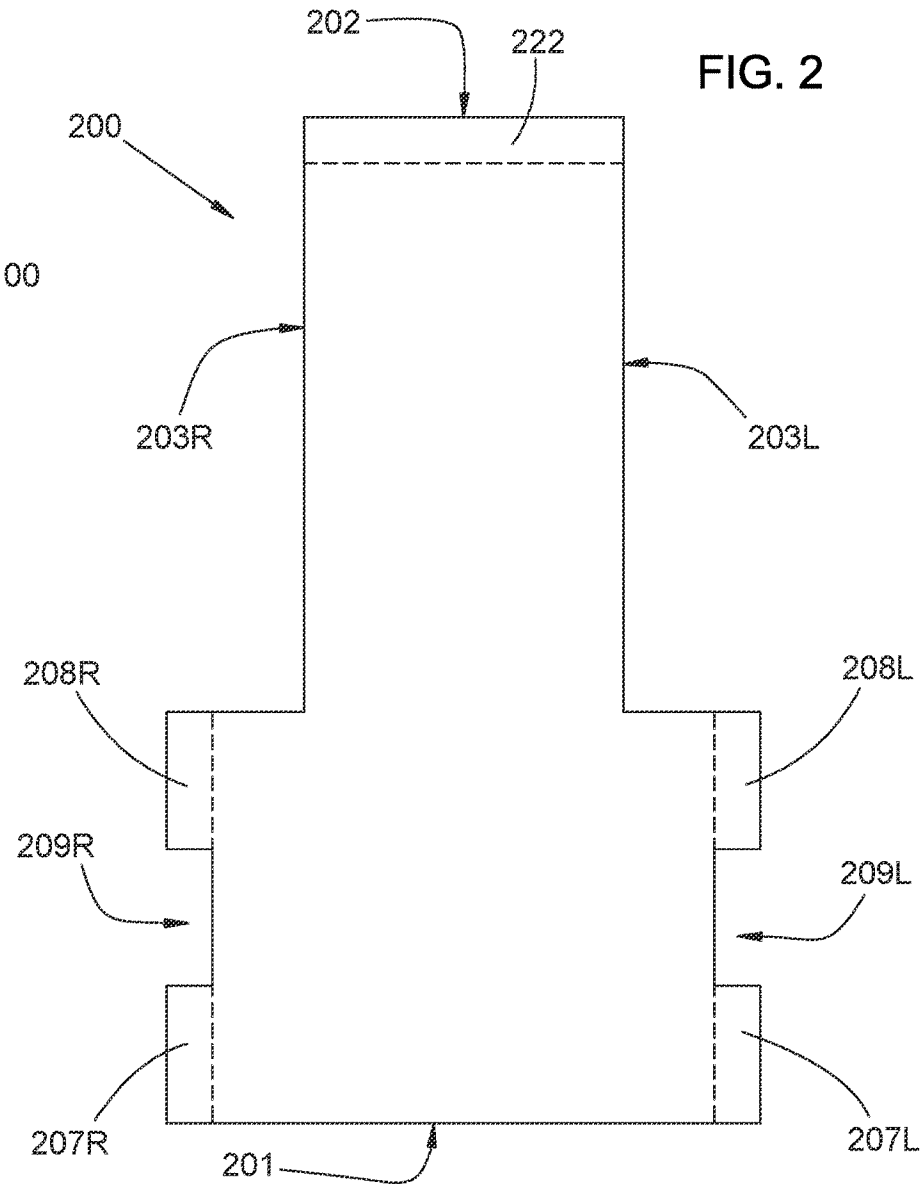
FIG. 2 is a top view of a flattened flexible sheet of the example inventive apparatus.
Figure 1D:
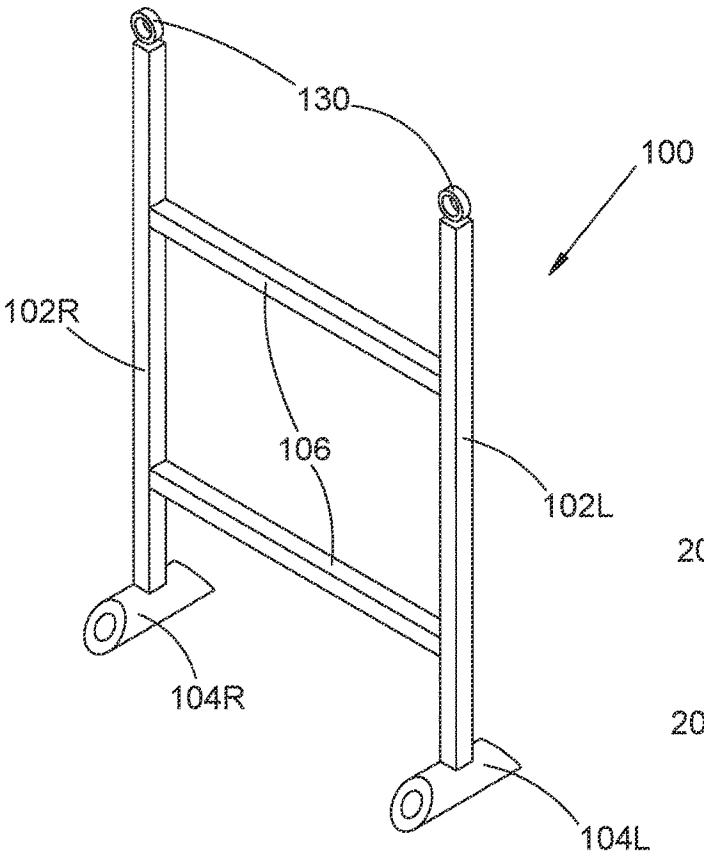
Figure 3:
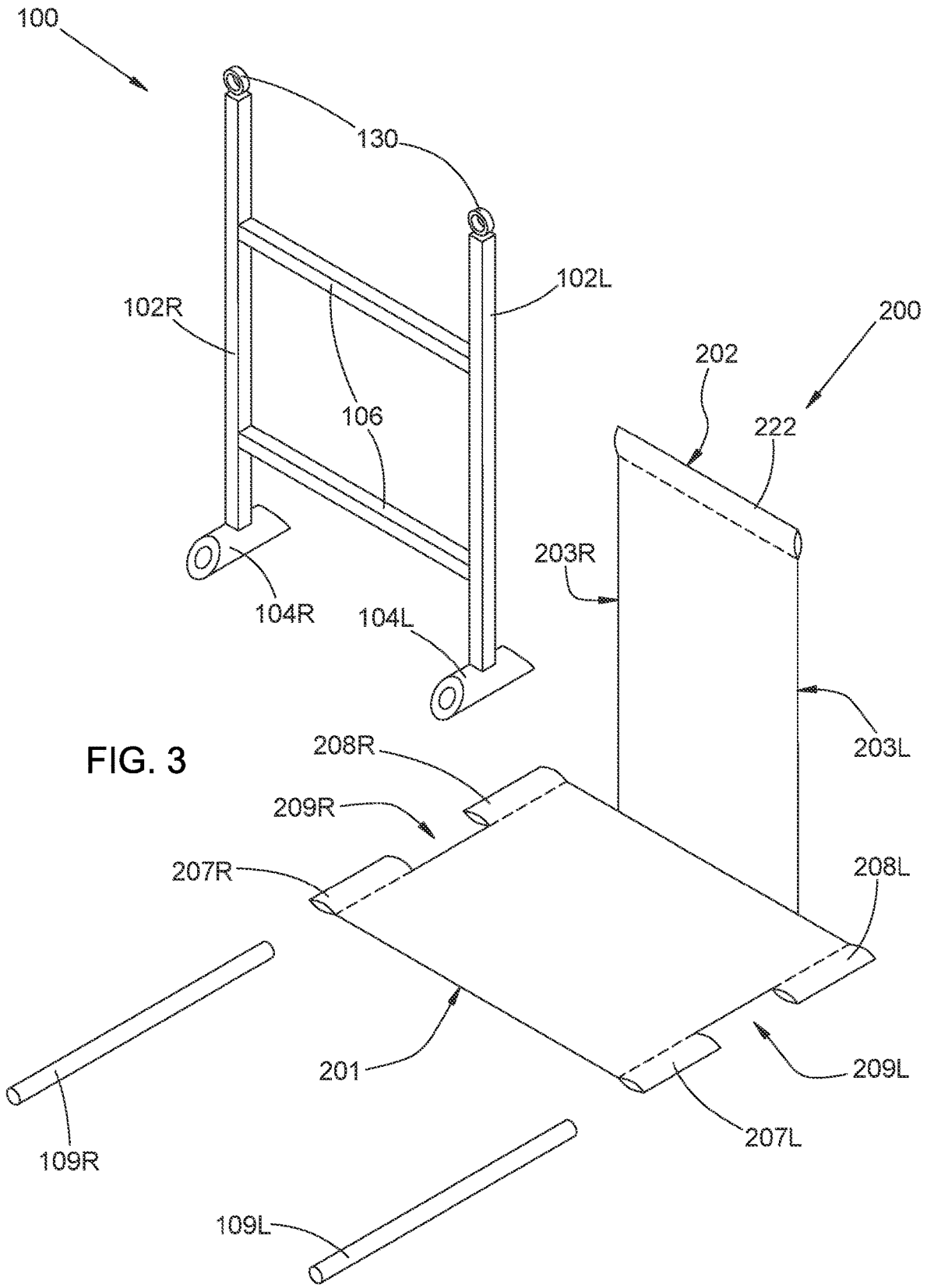
FIG. 3 is an exploded view of the example inventive apparatus.

The embodiments depicted are shown only schematically; all features may not be shown in full detail or in proper proportion; for clarity certain features or structures may be exaggerated or diminished relative to others or omitted entirely; the drawings should not be regarded as being to scale unless explicitly indicated as being to scale. The embodiments shown are only examples and should not be construed as limiting the scope of the present disclosure or appended claims.

DETAILED DESCRIPTION

The following detailed description should be read with reference to the drawings, in which identical reference numbers refer to like elements throughout the different figures. The drawings, which are not necessarily to scale, depict selective examples and are not intended to limit the scope of the disclosed inventive subject matter. The detailed description illustrates by way of example, not by way of limitation, the principles of the disclosed inventive subject matter.

For purposes of the present disclosure and appended claims the following definitions shall apply. The term "rigid" shall encompass a solid structure that is intended to maintain a substantially constant size and shape, but may nevertheless exhibit functionally negligible expansion, contraction, or flexure in the course of its normal use, due to, e.g., thermal expansion or contraction, or slight deformations (typically, but not necessarily, elastic) due to applied forces or torques.

The terms "upright", "longitudinal", "transverse", and the like are generally defined with respect to a person supported by the inventive apparatus in a seated position. "Upright" or "vertical" corresponds to a direction generally parallel to the seated person's spine; "horizontal" corresponds to a direction generally perpendicular to the vertical direction; "longitudinal" or "fore-and-aft" corresponds to a generally horizontal direction that is generally parallel to the seated person's thighs with knees together; "transverse" or "lateral" corresponds to a direction generally perpendicular to the vertical and longitudinal directions. None of those directions are intended to be exact: directions within, e.g., ±10°, ±5°, or ±3° of exactly vertical can be considered upright or vertical; directions within, e.g., ±10°, ±5°, or ±3° of exactly perpendicular to the vertical direction can be considered horizontal; directions within, e.g., ±10°, ±5°, or ±3° of exactly longitudinal can be considered fore-and-aft or longitudinal; and directions within, e.g., ±10°, ±5°, or ±3° of exactly perpendicular to both the vertical and longitudinal directions can be considered transverse. "Left" and "right" designations can be arbitrary; in the present description and claims they are defined from the point of view of a person supported by the inventive apparatus.

The term "collinear" shall encompass a pair of sleeves or similar generally tubular structures or arrangements within which a single straight, rigid rod can be positioned simultaneously within both sleeves of the pair. The pair of collinear sleeves can be exactly or substantially collinear, can be sufficiently large so as to enable positioning of the rod within both sleeves in spite of small angular or transverse deviations from collinearity, or can be flexibly connected together to permit sufficient relative movement of the sleeves to enable positioning of the rod within both sleeves.

An example of an inventive apparatus for supporting a person is illustrated schematically in FIGS. 1A-1D, 2, 3, and 4A-4C. The apparatus 10 includes a rigid frame 100, a flexible sheet 200, and a pair of rigid rods 109L and 109R. The rigid frame 100 includes a left upright member 102L, an open-ended left tube 104L, a right upright member 102R, an open-ended right tube 104R, and one or more cross members 106. The left and right tubes 104L and 104R are attached to the corresponding lower ends of the left and right upright members 102L and 102R, respectively. Each of the tubes 104L and 104R is attached to the corresponding upright member 102L or 102R in a longitudinal arrangement. Each cross member 106 connects together the left and right upright members 102L and 102R in a transversely spaced-apart arrangement that is sufficiently wide to enable the frame 100 to straddle thighs or hips of the person between the left and right tubes 104L and 104R. In some examples the frame can include only a single cross member 106; in other examples the frame can include multiple cross members 106. The example shown in the drawings includes two cross members 106; any necessary, desirable, or suitable number of cross members 106 can be employed.

In some examples the height of the frame 100 can be fixed; in other examples the height of the frame can be adjustable by any suitable arrangement, e.g., by employing telescoping upright members 102L and 102R, or by employing multi-part upright members 102L and 102R that each can be assembled to different lengths. In some examples the width of the frame 100 can be adjustable by any suitable arrangement, e.g., by employing telescoping cross members 106, or by employing one or more multi-part cross members 106 that each can be assembled to different lengths. The frame 100 can be constructed using any one or more suitably rigid, suitably strong materials, e.g., metals, plastics, wood, or composite materials, and can be constructed in any suitable way, e.g., integrally formed, welded, or assembled using fasteners or adhesives. The upright members 102L and 102R or the cross members 106 can be straight, curved, angled, open or closed polygonal, arranged as a truss or lattice, or shaped in any structurally or ergonomically suitable way. For simplicity, the example shown in the drawings incudes straight upright members 102L and 102R and straight cross members 106, but other shapes can be employed.

Figure 6:
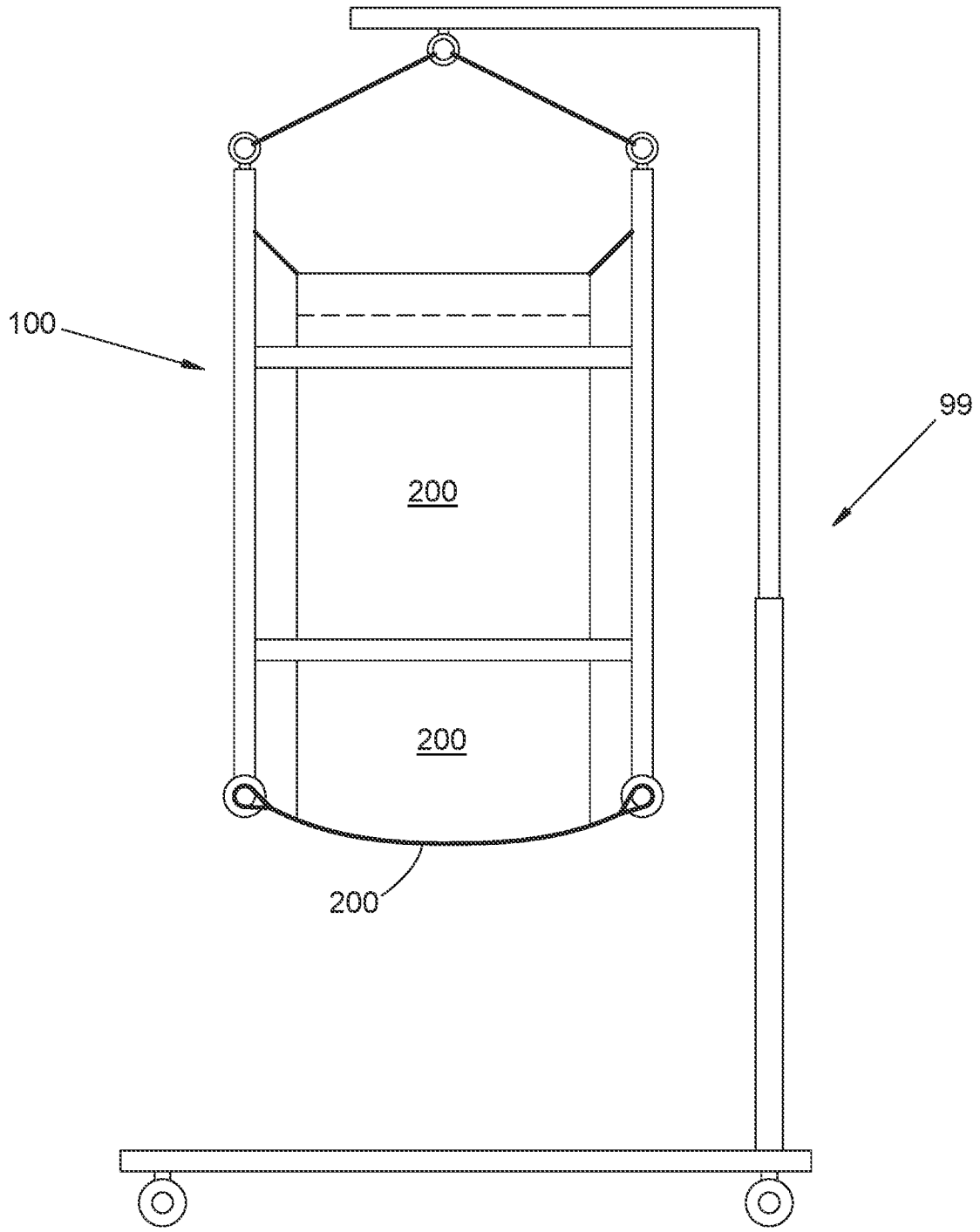
FIG. 6 illustrates schematically an example inventive apparatus supported by a lifting device.

The upper portion of the frame 100 can be arranged in any suitable way to enable the inventive apparatus, and a person supported by the apparatus, to be lifted by a lifting device 99, e.g., a patient lift or patient hoist (as in FIG. 6). In some examples the upper portion of the frame 100 (e.g., upper portions of the upright members 102L/102R, or an uppermost cross member 106) can include one or more arms, extensions, or brackets, one or more holes, one or more pins or lugs, or one or more hooks or eyes, one or more clips or carabiners, one or more bails, or other suitable element structurally arranged so as to enable attachment of the frame 100 to the lifting device. In the example shown, eyes 130 are attached to the top of the upright members 102L/102R and can engage a lifting sling that is in turn engaged with a lifting device 99 (e.g., a patient lift or hoist). In some examples the inventive apparatus can include one or more flexible attachment members (e.g., ties, ropes, cables, cords, or chains), one or more lifting slings, one or more spreader bars, one or more lifting bars, or other suitable lifting hardware attached to the upper portion of the frame 100 and arranged so as to enable attachment of the frame 100 to the lifting device 99.

Figure 5:
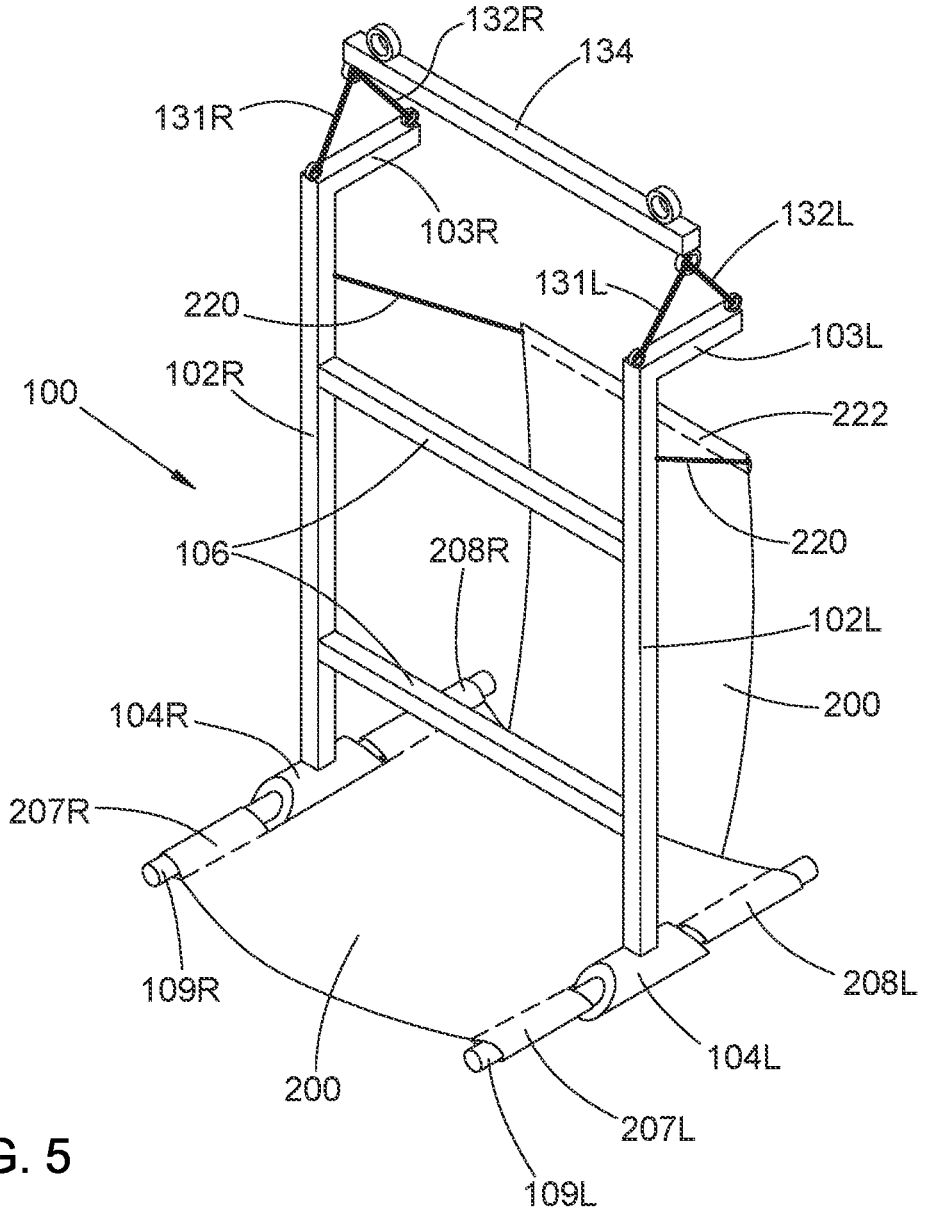
FIG. 5 is an isometric view of another example inventive apparatus assembled.

In the example inventive apparatus of FIG. 5, the frame 100 includes left and right longitudinal arms 103L and 103R attached to the upper portion of the frame 100 transversely space-apart from one another (in this example at the respective top ends of the upright members 102L/102R; other locations can be employed). The example apparatus further includes (i) a transverse lifting bar 134, (ii) a left front flexible attachment member 131L attaching a left portion of the lifting bar 134 to a forward portion of the left arm 103L, (iii) a left rear flexible attachment member 132L attaching the left portion of the lifting bar 134 to a rearward portion of the left arm 103L, (iv) a right front flexible attachment member 131R attaching a right portion of the lifting bar 134 to a forward portion of the right arm 103R, (v) a right rear flexible attachment member 132R attaching the right portion of the lifting bar 134 to a rearward portion of the right arm 103R. The arrangement of FIG. 5 can provide improved stability with respect to forward or rearward tilt. In some such examples, relative lengths of the left front, left rear, right front, and right rear flexible attachment members 131L/132L/131R/132R can be adjusted with respect to one another, to enable adjustment of the forward or rearward tilt of the apparatus when lifted by a lifting device. Such adjustment can be made in any suitable way, e.g., by securing different links of chain attachment members 131L132L/131R/132R to the lifting bar 134 or longitudinal arms 103L/103R.

The sheet 200 is made of flexible material, has an upper edge 201, a lower edge 202, a left side edge 203L, and a right side edge 203R, and includes a pair of collinear left sleeves 207L and 208L and a pair of collinear right sleeves 207R and 208R. The sheet 200 can be made of any one or more suitably strong, flexible materials, e.g., natural or synthetic textile fabrics such as canvas, plastic or polymer sheet, braid, or mesh, metal braid or mesh, and so forth. The pair of collinear left sleeves 207L and 208L are attached to a lower portion of the left edge 203L with a gap 209L between them; the gap 209L is at least as long as the length of the left tube 104L. The pair of collinear right sleeves 207R and 208R are attached to a lower portion of the right edge 203R with a gap 209R between them; the gap 209R is at least as long as the length of the right tube 104R. An upper portion of the sheet 200, and corresponding upper portions of the left and right side edges 203L and 203R, extend beyond the sleeves 207L/208L/207R/208R toward the upper edge 201 of the sheet 200. Between the left sleeves 207L/208L and the right sleeves 207R/208R, the lower portion of the sheet 200 is at least as wide as the distance between the left and right tubes 104L/104R of the frame 100. In the example shown the upper portion of the sheet 200 is narrower than the lower portion, but this need not be the case. In some examples, the sleeves 207L/208L/207R/208R can be formed from flexible material of the sheet 200, e.g., by folding over a strip of material along the corresponding side edge of the sheet and attaching it to the sheet using fasteners or by forming a sewn or welded seam (indicated by dashed lines in the drawings). In some examples, the sleeves 207L/208L/207R/208R can be formed from flexible material different from that of the sheet 200 and attached to the sheet 200 in any suitable way. In some examples, the sleeves 207L/208L/207R/208R can be formed from any suitable rigid material (e.g., metal, plastic, composite, or other) and attached to the sheet 200 in any suitable way.

One or both of an upper portion of the frame 100 or the upper portion of the sheet 200 are structurally arranged so as to enable attachment of the upper portion of the sheet 200 to, and detachment of the upper portion of the sheet 200 from, the upper portion of the frame 100. In some examples, the upper portion of the sheet 200 can include one or more holes, one or more sleeves, one or more hooks or eyes, one or more clips or carabiners, one or more snaps or buttons, one or more hook-and-loop connectors, one or more flexible attachment members (e.g., ties, ropes, cables, cords, or chains), or other suitable attachment elements structurally arranged so as to enable attachment to and detachment from the upper portion of the frame 100. In some examples, the upper portion of the frame 100 can include one or more holes, one or more pins or lugs, or one or more hooks or eyes, one or more clips or carabiners, one or more flexible attachment members (e.g., ties, ropes, cables, cords, or chains), one or more bails, or other suitable attachment elements structurally arranged so as to enable attachment to and detachment from the upper portion of the sheet 200. In the example shown, a rope 220 passes through a sleeve 222 formed at the top edge 201 of the sheet 200 and is attached in any suitable way to the frame 100; other suitable arrangements can be employed.

The left rod 109L and the right rod 109R are made of any suitably strong, rigid material, including any of the materials discussed above for forming the frame 100. In some examples the frame 100 and rods 109L/109R can be made of the same material; in other examples the rods 109L/109R can be formed from material different from that of the frame 100. Each of the rods 109L and 109R is longer than its corresponding tube 104L or 104R of the frame 100, and has corresponding transverse shape and dimensions that enable it to be inserted through its corresponding tube 104L or 104R, and at least partly through the corresponding pairs of sleeves 207L/208L or 207R/208R. Any suitable transverse shape can be employed; in some examples the rods 109L/109R and the corresponding tubes 104L/104R are cylindrical. The rods 109L and 109R typically are the same size and shape as one another, although that need not be the case; similarly, the tubes 104L and 104R typically are the same size and shape as one another, although that need not be the case. In some examples, one or both ends of one or both tubes 104L/104R can be beveled so as to facilitate insertion through them of the corresponding rods 109L/109R. In some examples, one or both ends of one or both rods 109L/109R can be tapered so as to facilitate their insertion through the corresponding tubes 104L/104R or at least partly through the corresponding sleeves 207L/208L/207R/208R.

Figure 4B:
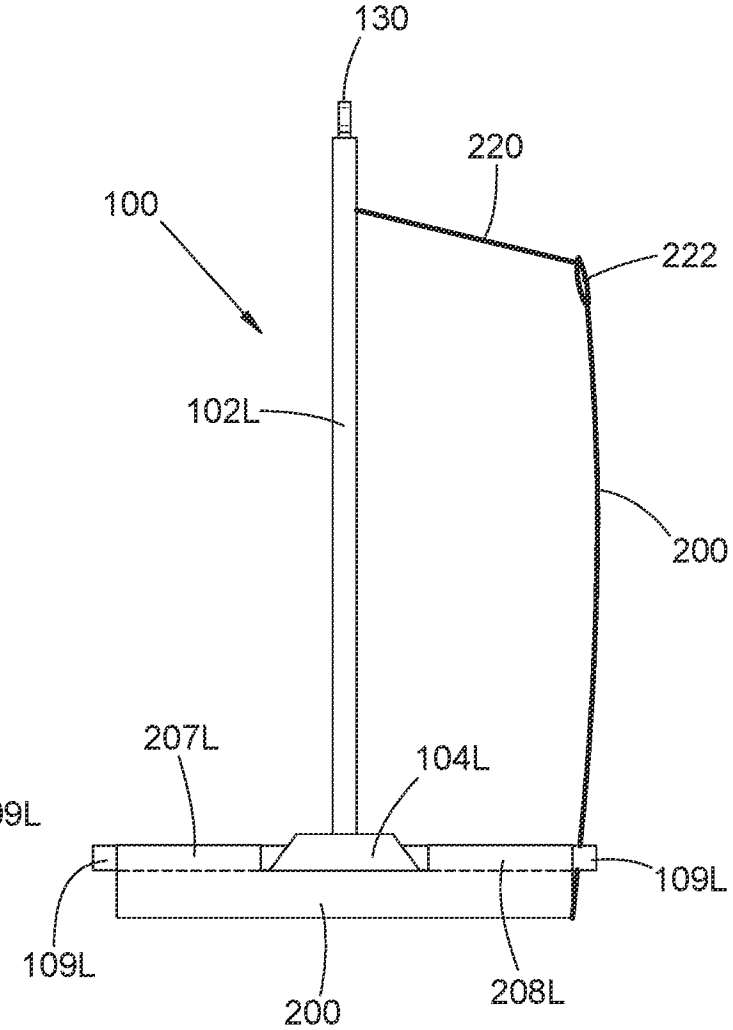
FIGS. 4A through 4C are front, side, and isometric views of the example inventive apparatus assembled.
Figure 4A:
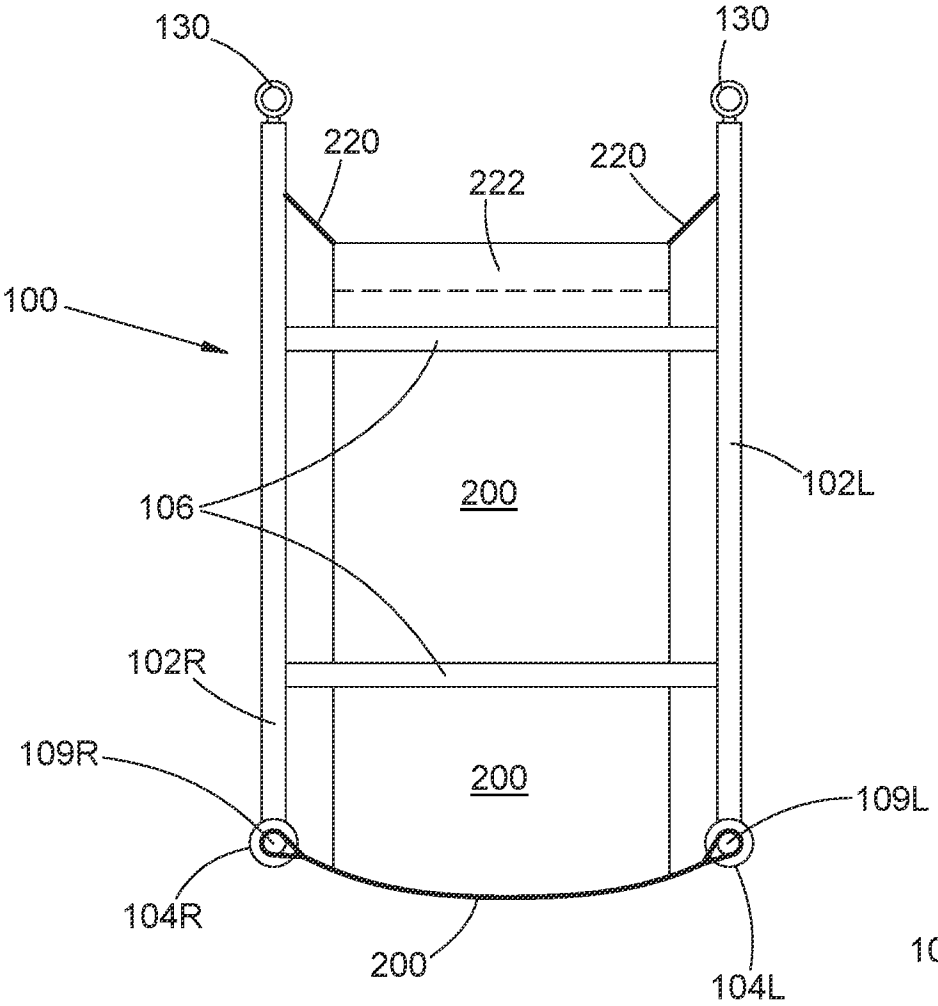
Figure 4C:
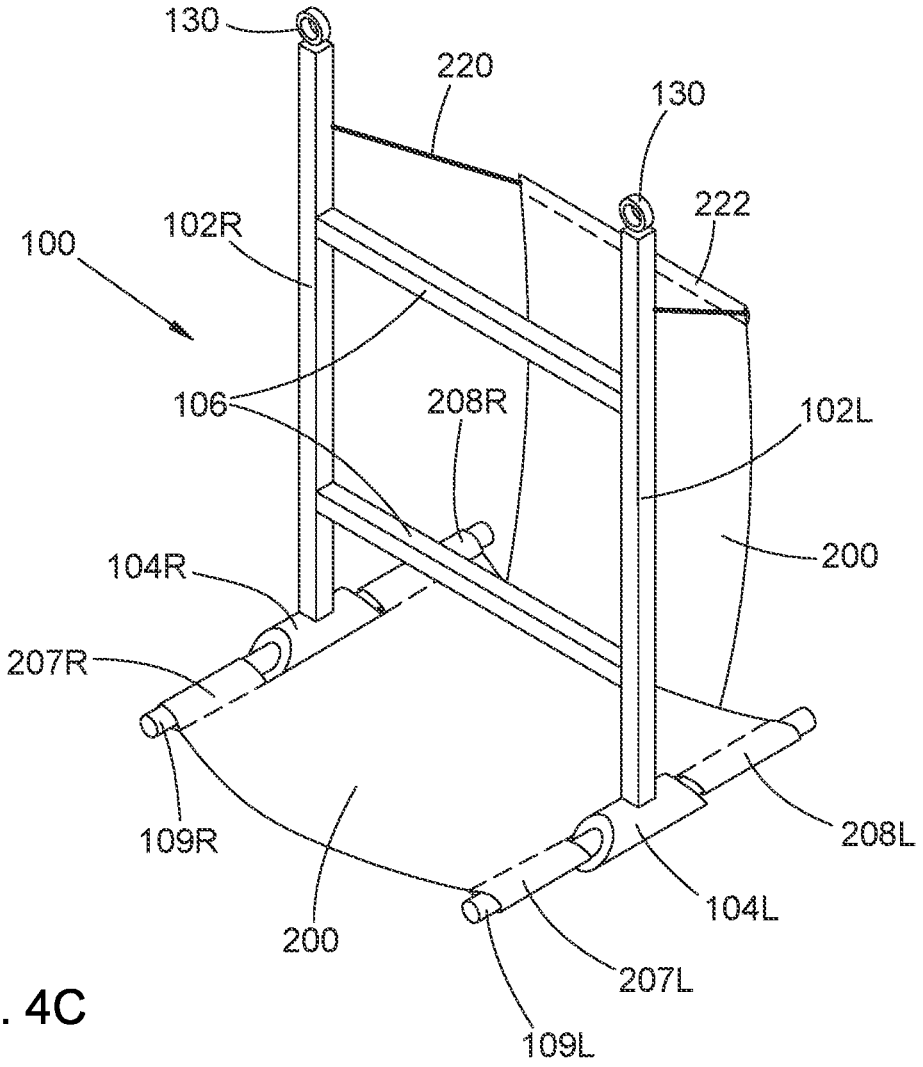

The inventive apparatus is shown disassembled in FIGS. 1A-1D, 2, and 3, and assembled in FIGS. 4A-4C. To assemble the inventive apparatus, the tubes 104L/104R are positioned in the corresponding gaps 209L/209R of the sheet 200. The left rod 109L is positioned through the left tube 104L and at least partly within both of the left sleeves 207L/208L; the right rod 109R is positioned through the right tube 104R and at least partly within both of the right sleeves 207R/208R. The upper portion of the sheet 200 is attached to the upper portion of the frame 100. With the apparatus thus assembled, the sheet 200 forms a support for the person, the lower portion of the sheet 200 forming a horizontal seat portion of the support and the upper portion of the sheet 200 forming an upright or inclined back portion of the support.

Typically, the assembly procedure can be performed with the person sitting (e.g., on a bed, or on a chair or other seat) upright on the lower portion of the sheet 200 facing the lower edge 202 of the sheet 200, with the upper portion of the sheet 200 behind the person. The sheet 200 can be placed beneath the person immediately before assembling the apparatus, or can already be in place under the person after a previous disassembly of the apparatus (discussed below). The frame 100 is positioned to straddle the person, with the person's thighs or hips between the tubes 104L/104R, and with the tubes 104L/104R in the corresponding gaps 209L/209R of the sheet 200. The rods 109L/109R are then positioned through the corresponding tubes 104L/104R and within the corresponding sleeves 207L/208L/207R/208R. The upper portion of the frame 100 can be attached to the lifting device 99, either before assembly or after, and after assembly the lifting device 99 can be used to lift the assembled inventive apparatus and the person supported thereon in a seated position.

The supported person can be moved from one location to another by moving the lifting device 99, which often includes wheels or casters for that purpose. When the person has been moved to a desired location and positioned above a bed or above a chair or other seat, the lifting device 99 can be used to lower the inventive apparatus and the supported person onto the bed or seat. With the person sitting upright on the bed or seat, the upper portion of the sheet 200 is detached from the upper portion of the frame 100, the rods 109L/109R are removed from the corresponding tubes 104L/104R and from the corresponding sleeves 207L/208L/207R/208R, and the frame 100 is removed from its position straddling the person (resulting in removal of the tubes 104L/104R from the corresponding gaps 209L/209R of the sheet 200). The apparatus can be disassembled with upper portion of the frame 100 still attached to the lifting device 99, or the frame 100 can be detached from the lifting device 99 before disassembling the apparatus. If the person is sitting on a bed, he or she can remain sitting, or can lie down at any time after detachment of the upper portion of the sheet 200 from the upper portion of the frame 100. After disassembly of the apparatus, the sheet 200 can be removed from beneath the person if desired. Alternatively, the sheet 200 can be left in place beneath the person, so as to be in position already the next time the person is to be lifted and moved.

Figure 7:
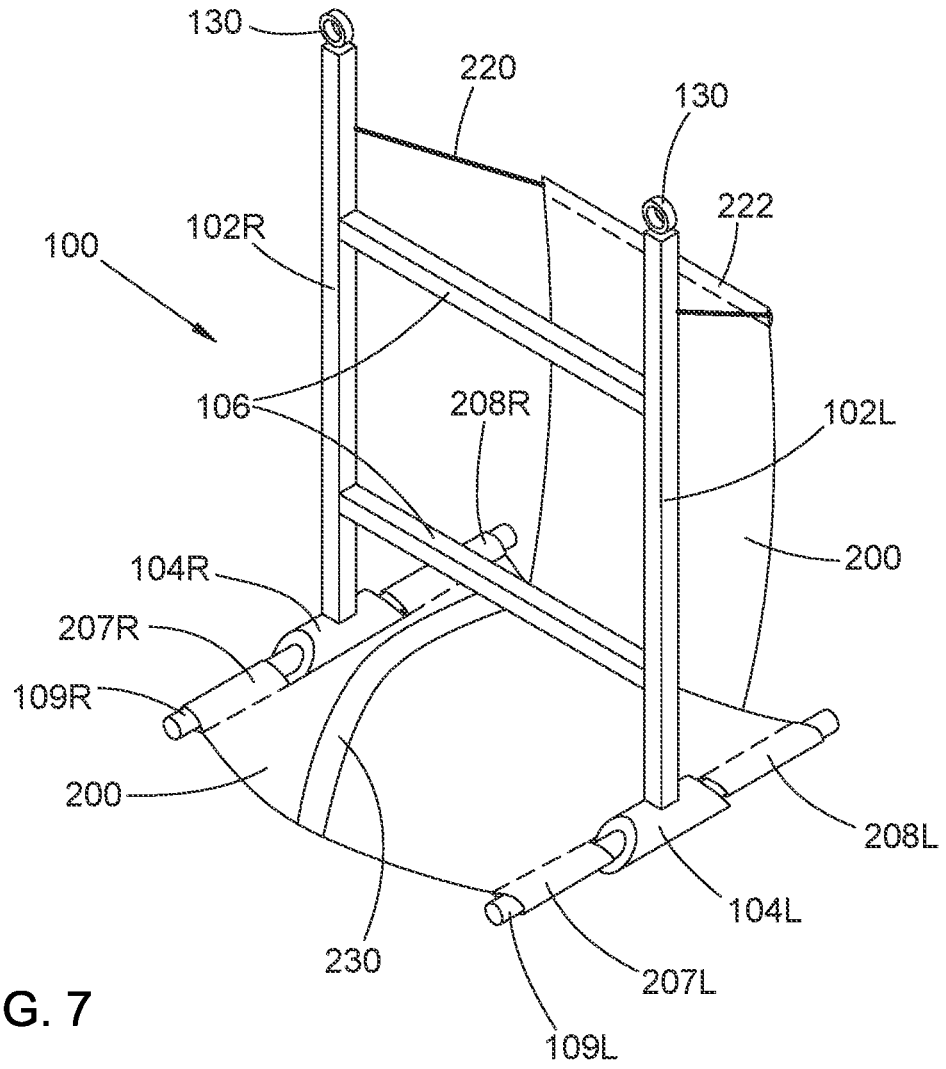
FIG. 7 is an isometric view of another example inventive apparatus assembled.

In some examples, the inventive apparatus can include one or more restraint members 230 structurally arranged to be attached to, and detached from, one or both of the sheet 200 or the frame 100. Such a restraint member 230 can be arranged as one or more straps or belts, one or more webs, or in any other suitable way, and can be attached to the sheet 200 or frame 100 using clips, buckles, clasps, carabiners, hook-and-loop fasteners, or in any other suitable way. With the person supported in a sitting position by the assembled inventive apparatus, the one or more restraint members 230 can be attached in an arrangement that obstructs movement of the person off of the support. Such a safety feature can reduce the likelihood of the person falling out of the inventive device while being supported, lifted, or moved. The restraint member(s) 230 can be arranged in any suitable way, e.g., as a seatbelt or lap belt or shoulder strap connected to one or both of the sheet 200 or the frame 100, or connected to the lower edge 202 of the sheet 200 between the legs of the person and to a cross member 106 of the frame 100 (e.g., as in FIG. 7).

In addition to the preceding, the following example embodiments fall within the scope of the present disclosure or appended claims:

Example 1. An apparatus comprising: (a) a rigid frame including (i) a left upright member, (ii) an open-ended left tube attached to a lower end of the left upright member in a longitudinal arrangement, (iii) a right upright member, (iv) an open-ended right tube attached to a lower end of the right upright member in a longitudinal arrangement, and (v) one or more cross members connecting together the left and right upright members in a transversely spaced-apart arrangement that is sufficiently wide to enable the frame to straddle thighs or hips of a person between the left and right tubes; (b) a sheet of flexible material having (i) upper, lower, left side, and right side edges, (ii) a pair of collinear left sleeves attached to a lower portion of the left edge with a gap therebetween at least as long as a length of the left tube, and (iii) a pair of collinear right sleeves attached to a lower portion of the right edge with a gap therebetween at least as long as a length of the right tube, (iv) wherein an upper portion of the sheet and corresponding upper portions of the left and right side edges extend beyond the pairs of left and right sleeves toward the upper edge of the sheet, and (v) wherein a lower portion of the sheet is at least as wide between the left and right sleeves as distance between the left and right tubes; and (c) a pair of rigid rods, wherein (i) a left rod of the pair is longer than the left tube and has transverse shape and dimensions that enable the left rod to be inserted through the left tube and at least partly through the left sleeves and (ii) a right rod of the pair is longer than the right tube and has transverse shape and dimensions that enable the right rod to be inserted through the right tube and at least partly through the right sleeves, (d) one or both of an upper portion of the frame or the upper portion of the sheet being structurally arranged so as to enable attachment of the upper portion of the sheet to, and detachment of the upper portion of the sheet from, the upper portion of the frame.

Example 2. The apparatus of Example 1 wherein (i) one or both ends of the left tube are beveled so as to facilitate insertion of the left rod therethrough, or (ii) one or both ends of the right tube are beveled so as to facilitate insertion of the right rod therethrough.

Example 3. The apparatus of any one of Examples 1 or 2 wherein (i) one or both ends of the left rod are tapered so as to facilitate insertion of the left rod through the left tube or at least partly through the left sleeves, or (ii) one or both ends of the right rod are tapered so as to facilitate insertion of the right rod through the right tube or at least partly through the right sleeves.

Example 4. The apparatus of any one of Examples 1 through 3 wherein (i) the left and right rods are substantially identical to one another, and (ii) the left and right tubes are substantially identical to one another.

Example 5. The apparatus of any one of Examples 1 through 4 wherein the upper portion of the frame includes one or more arms, extensions, or brackets, one or more holes, one or more pins or lugs, one or more clips or carabiners, one or more hooks or eyes, or one or more bails arranged so as to enable attachment of the frame to a lifting device.

Example 6. The apparatus of any one of Examples 1 through 5 further comprising one or more flexible attachment members, one or more lifting slings, one or more spreader bars, or one or more lifting bars attached to the upper portion of the frame and arranged so as to enable attachment of the frame to a lifting device.

Example 7. The apparatus of any one of Examples 1 through 6 wherein the frame includes left and right longitudinal arms attached to the upper portion of the frame transversely space-apart from one another, the apparatus further comprising: (e) a transverse lifting bar; (f) a left front flexible attachment member attaching a left portion of the lifting bar to a forward portion of the left arm, (g) a left rear flexible attachment member attaching the left portion of the lifting bar to a rearward portion of the left arm, (f) a right front flexible attachment member attaching a right portion of the lifting bar to a forward portion of the right arm, (f) a right rear flexible attachment member attaching the right portion of the lifting bar to a rearward portion of the right arm.

Example 8. The apparatus of Example 7 wherein relative lengths of the left front, left rear, right front, and right rear flexible attachment members are adjustable with respect to one another.

Example 9. The apparatus of any one of Examples 1 through 8 wherein each one of the left and right sleeves is formed from flexible material of the sheet or from flexible material different from that of the sheet.

Example 10. The apparatus of any one of Examples 1 through 8 wherein each one of the left and right sleeves is formed from rigid material and attached to the sheet.

Example 11. The apparatus of any one of Examples 1 through 10 wherein the upper portion of the frame includes one or more holes, one or more pins or lugs, or one or more hooks or eyes, one or more clips or carabiners, one or more attached ties, cords, chains, ropes, or cables, or one or more bails structurally arranged so as to enable attachment of the upper portion of the sheet to, and detachment of the upper portion of the sheet from, the upper portion of the frame.

Example 12. The apparatus of any one of Examples 1 through 11 wherein the upper portion of the sheet includes one or more holes, one or more sleeves, one or more hooks or eyes, one or more clips or carabiners, one or more snaps or buttons, one or more hook-and-loop connectors, or one or more ties, ropes, cables, cords, or chains structurally arranged so as to enable attachment of the upper portion of the sheet to, and detachment of the upper portion of the sheet from, the upper portion of the frame.

Example 13. The apparatus of any one of Examples 1 through 12 wherein the frame is structurally arranged so as to exhibit adjustable height or width.

Example 14. The apparatus of any one of Examples 1 through 13 wherein the frame includes multiple cross members.

Example 15. The apparatus of any one of Examples 1 through 14 further comprising one or more restraint members structurally arranged to be attached to, and detached from, one or both of the sheet or the frame.

Example 16. A method employing the apparatus of any one of Examples 1 through 15, the method comprising: (A) positioning the left tube in the gap between the left sleeves, and positioning the left rod through the left tube and at least partly within both of the left sleeves; (B) positioning the right tube in the gap between the right sleeves, and positioning the right rod through the right tube and at least partly within both of the right sleeves; and (C) attaching the upper portion of the sheet to the upper portion of the frame, (D) the sheet forming a support for the person, the lower portion of the sheet forming a horizontal seat portion of the support and the upper portion of the sheet forming an upright or inclined back portion of the support.

Example 17. The method of Example 16 wherein parts (A), (B), and (C) are performed with the person sitting upright on the lower portion of the sheet facing the lower edge of the sheet with the upper portion of the sheet behind the person, and with the frame straddling the legs or hips of the person.

Example 18. The method of any one of Examples 16 or 17 further comprising, before part (A), positioning the sheet beneath the person.

Example 19. The method of any one of Examples 16 through 18 further comprising attaching the upper portion of the frame to a lifting device.

Example 20. The method of any one of Examples 16 through 19 further comprising using a lifting device to lift the apparatus and the person sitting thereon.

Example 21. The apparatus of any one of Examples 1 through 15: (i) the left tube being positioned in the gap between the left sleeves, and the left rod being positioned through the left tube and at least partly within both of the left sleeves; (ii) the right tube being positioned in the gap between the right sleeves, and the right rod being positioned through the right tube and at least partly within both of the right sleeves; (iii) the upper portion of the sheet being attached to the upper portion of the frame; and (iv) the sheet forming a support for the person, the lower portion of the sheet forming a horizontal seat portion of the support and the upper portion of the sheet forming an upright or inclined back portion of the support.

Example 22. The apparatus of Example 21 further comprising one or more restraint members attached to one or both of the sheet or the frame and structurally arranged so as to obstruct movement of the person, while seated on the support, off of the support.

Example 23. A method employing the apparatus of any one of Examples 21 or 22, the method comprising: (A) with the person sitting upright on the support, detaching the upper portion of the sheet from the upper portion of the frame; (B) removing the left rod from one or both of the left sleeves and from the left tube, and removing the right rod from one or both of the right sleeves and from the right tube; and (C) removing the left tube from the gap between the left sleeves, removing the right tube from the gap between the right sleeves, and removing the frame from a position straddling the legs or hips of the person.

Example 24. The method of Example 23 further comprising, after part (C), removing the sheet from beneath the person.

Example 25. A method employing the apparatus of any one of Examples 21 or 22, the method comprising: (A) with a person sitting upright on the support, using the lifting device to lift the apparatus and the person sitting thereon; (B) with the lifting device supporting the apparatus and the person sitting thereon, moving the lifting device to a different location; and (C) using the lifting device to lower the apparatus and the person sitting thereon onto a seat or bed.

Example 26. The method of Example 25 further comprising, before part (A), attaching a lifting device to the upper portion of the frame.

Example 27. The method of any one of Examples 25 or 26 further comprising, after part (C), detaching the lifting device from the upper portion of the frame.

This disclosure is illustrative and not limiting. Further modifications will be apparent to one skilled in the art in light of this disclosure and are intended to fall within the scope of the present disclosure or appended claims. It is intended that equivalents of the disclosed example embodiments and methods, or modifications thereof, shall fall within the scope of the present disclosure or appended claims.

In the foregoing Detailed Description, various features may be grouped together in several example embodiments for the purpose of streamlining the disclosure. This method of disclosure is not to be interpreted as reflecting an intention that any claimed embodiment requires more features than are expressly recited in the corresponding claim. Rather, as the appended claims reflect, inventive subject matter may lie in less than all features of a single disclosed example embodiment. Therefore, the present disclosure shall be construed as implicitly disclosing any embodiment having any suitable subset of one or more features—which features are shown, described, or claimed in the present application—including those subsets that may not be explicitly disclosed herein. A "suitable" subset of features includes only features that are neither incompatible nor mutually exclusive with respect to any other feature of that subset. Accordingly, the appended claims are hereby incorporated in their entirety into the Detailed Description, with each claim standing on its own as a separate disclosed embodiment. In addition, each of the appended dependent claims shall be interpreted, only for purposes of disclosure by said incorporation of the claims into the Detailed Description, as if written in multiple dependent form and dependent upon all preceding claims with which it is not inconsistent. It should be further noted that the cumulative scope of the appended claims can, but does not necessarily, encompass the whole of the subject matter disclosed in the present application.

The following interpretations shall apply for purposes of the present disclosure and appended claims. The words "comprising," "including," "having," and variants thereof, wherever they appear, shall be construed as open ended terminology, with the same meaning as if a phrase such as "at least" were appended after each instance thereof, unless explicitly stated otherwise. The article "a" shall be interpreted as "one or more" unless "only one," "a single," or other similar limitation is stated explicitly or is implicit in the particular context; similarly, the article "the" shall be interpreted as "one or more of the" unless "only one of the," "a single one of the," or other similar limitation is stated explicitly or is implicit in the particular context. The conjunction "or" is to be construed inclusively unless: (i) it is explicitly stated otherwise, e.g., by use of "either . . . or," "only one of," or similar language; or (ii) two or more of the listed alternatives are understood or disclosed (implicitly or explicitly) to be incompatible or mutually exclusive within the particular context. In that latter case, "or" would be understood to encompass only those combinations involving non-mutually-exclusive alternatives. In one example, each of "a dog or a cat," "one or more of a dog or a cat," and "one or more dogs or cats" would be interpreted as one or more dogs without any cats, or one or more cats without any dogs, or one or more of each. In another example, each of "a dog, a cat, or a mouse," "one or more of a dog, a cat, or a mouse," and "one or more dogs, cats, or mice" would be interpreted as (i) one or more dogs without any cats or mice, (ii) one or more cats without and dogs or mice, (iii) one or more mice without any dogs or cats, (iv) one or more dogs and one or more cats without any mice, (v) one or more dogs and one or more mice without any cats, (vi) one or more cats and one or more mice without any dogs, or (vii) one or more dogs, one or more cats, and one or more mice. In another example, each of "two or more of a dog, a cat, or a mouse" or "two or more dogs, cats, or mice" would be interpreted as (i) one or more dogs and one or more cats without any mice, (ii) one or more dogs and one or more mice without any cats, (iii) one or more cats and one or more mice without and dogs, or (iv) one or more dogs, one or more cats, and one or more mice; "three or more," "four or more," and so on would be analogously interpreted.

For purposes of the present disclosure or appended claims, when terms are employed such as "about equal to," "substantially equal to," "greater than about," "less than about," and so forth, in relation to a numerical quantity, standard conventions pertaining to measurement precision and significant digits shall apply, unless a differing interpretation is explicitly set forth. For null quantities described by phrases such as "substantially prevented," "substantially absent," "substantially eliminated," "about equal to zero," "negligible," and so forth, each such phrase shall denote the case wherein the quantity in question has been reduced or diminished to such an extent that, for practical purposes in the context of the intended operation or use of the disclosed or claimed apparatus or method, the overall behavior or performance of the apparatus or method does not differ from that which would have occurred had the null quantity in fact been completely removed, exactly equal to zero, or otherwise exactly nulled.

For purposes of the present disclosure and appended claims, any labelling of elements, steps, limitations, or other portions of an embodiment, example, or claim (e.g., first, second, third, etc., (a), (b), (c), etc., or (i), (ii), (iii), etc.) is only for purposes of clarity, and shall not be construed as implying any sort of ordering or precedence of the portions so labelled. If any such ordering or precedence is intended, it will be explicitly recited in the embodiment, example, or claim or, in some instances, it will be implicit or inherent based on the specific content of the embodiment, example, or claim. In the appended claims, if the provisions of 35 USC § 112(f) are desired to be invoked in an apparatus claim, then the word "means" will appear in that apparatus claim. If those provisions are desired to be invoked in a method claim, the words "a step for" will appear in that method claim. Conversely, if the words "means" or "a step for" do not appear in a claim, then the provisions of 35 USC § 112(f) are not intended to be invoked for that claim.

If any one or more disclosures are incorporated herein by reference and such incorporated disclosures conflict in part or whole with, or differ in scope from, the present disclosure, then to the extent of conflict, broader disclosure, or broader definition of terms, the present disclosure controls. If such incorporated disclosures conflict in part or whole with one another, then to the extent of conflict, the later-dated disclosure controls.

The Abstract is provided as required as an aid to those searching for specific subject matter within the patent literature. However, the Abstract is not intended to imply that any elements, features, or limitations recited therein are necessarily encompassed by any particular claim. The scope of subject matter encompassed by each claim shall be determined by the recitation of only that claim.

What is claimed is:

1. An apparatus comprising:

(a) a rigid frame including (i) a left upright member, (ii) an open-ended left tube attached to a lower end of the left upright member in a longitudinal arrangement, (iii) a right upright member, (iv) an open-ended right tube attached to a lower end of the right upright member in a longitudinal arrangement, and (v) one or more cross members connecting together the left and right upright members in a transversely spaced-apart arrangement that is sufficiently wide to enable the frame to straddle thighs or hips of a person between the left and right tubes;

(b) a sheet of flexible material having (i) upper, lower, left side, and right side edges, (ii) a pair of collinear left sleeves attached to a lower portion of the left edge with a gap therebetween at least as long as a length of the left tube, and (iii) a pair of collinear right sleeves attached to a lower portion of the right edge with a gap therebetween at least as long as a length of the right tube, (iv) wherein an upper portion of the sheet and corresponding upper portions of the left and right side edges extend beyond the pairs of left and right sleeves toward the upper edge of the sheet, and (v) wherein a lower portion of the sheet is at least as wide between the left and right sleeves as distance between the left and right tubes; and (c) a pair of rigid rods, wherein (i) a left rod of the pair is longer than the left tube and has transverse shape and dimensions that enable the left rod to be inserted through the left tube and at least partly through the left sleeves and (ii) a right rod of the pair is longer than the right tube and has transverse shape and dimensions that enable the right rod to be inserted through the right tube and at least partly through the right sleeves, (d) one or both of an upper portion of the frame or the upper portion of the sheet being structurally arranged so as to enable attachment of the upper portion of the sheet to, and detachment of the upper portion of the sheet from, the upper portion of the frame.

2. The apparatus of claim 1 wherein (i) one or both ends of the left tube are beveled so as to facilitate insertion of the left rod therethrough, or (ii) one or both ends of the right tube are beveled so as to facilitate insertion of the right rod therethrough.

3. The apparatus of claim 1 wherein (i) one or both ends of the left rod are tapered so as to facilitate insertion of the left rod through the left tube or at least partly through the left sleeves, or (ii) one or both ends of the right rod are tapered so as to facilitate insertion of the right rod through the right tube or at least partly through the right sleeves.

4. The apparatus of claim 1 wherein (i) the left and right rods are substantially identical to one another, and (ii) the left and right tubes are substantially identical to one another.

5. The apparatus of claim 1 wherein the upper portion of the frame includes one or more arms, extensions, or brackets, one or more holes, one or more pins or lugs, one or more clips or carabiners, one or more hooks or eyes, or one or more bails arranged so as to enable attachment of the frame to a lifting device.

6. The apparatus of claim 1 further comprising one or more flexible attachment members, one or more lifting slings, one or more spreader bars, or one or more lifting bars attached to the upper portion of the frame and arranged so as to enable attachment of the frame to a lifting device.

7. The apparatus of claim 1 wherein the frame includes left and right longitudinal arms attached to the upper portion of the frame transversely space-apart from one another, the apparatus further comprising: (e) a transverse lifting bar; (f) a left front flexible attachment member attaching a left portion of the lifting bar to a forward portion of the left arm, (g) a left rear flexible attachment member attaching the left portion of the lifting bar to a rearward portion of the left arm, (f) a right front flexible attachment member attaching a right portion of the lifting bar to a forward portion of the right arm, (f) a right rear flexible attachment member attaching the right portion of the lifting bar to a rearward portion of the right arm.

8. The apparatus of claim 7 wherein relative lengths of the left front, left rear, right front, and right rear flexible attachment members are adjustable with respect to one another.

9. The apparatus of claim 1 wherein each one of the left and right sleeves is formed from flexible material of the sheet or from flexible material different from that of the sheet.

10. The apparatus of claim 1 wherein each one of the left and right sleeves is formed from rigid material and attached to the sheet.

11. The apparatus of claim 1 wherein the upper portion of the frame includes one or more holes, one or more pins or lugs, or one or more hooks or eyes, one or more clips or carabiners, one or more attached ties, cords, chains, ropes, or cables, or one or more bails structurally arranged so as to enable attachment of the upper portion of the sheet to, and detachment of the upper portion of the sheet from, the upper portion of the frame.

12. The apparatus of claim 1 wherein the upper portion of the sheet includes one or more holes, one or more sleeves, one or more hooks or eyes, one or more clips or carabiners, one or more snaps or buttons, one or more hook-and-loop connectors, or one or more ties, ropes, cables, cords, or chains structurally arranged so as to enable attachment of the upper portion of the sheet to, and detachment of the upper portion of the sheet from, the upper portion of the frame.

13. The apparatus of claim 1 wherein the frame is structurally arranged so as to exhibit adjustable height or width.

14. The apparatus of claim 1 wherein the frame includes multiple cross members.

15. The apparatus of claim 1 further comprising one or more restraint members structurally arranged to be attached to, and detached from, one or both of the sheet or the frame.

16. A method employing the apparatus of claim 1, the method comprising:

(A) positioning the left tube in the gap between the left sleeves, and positioning the left rod through the left tube and at least partly within both of the left sleeves;

(B) positioning the right tube in the gap between the right sleeves, and positioning the right rod through the right tube and at least partly within both of the right sleeves; and (C) attaching the upper portion of the sheet to the upper portion of the frame, (D) the sheet forming a support for the person, the lower portion of the sheet forming a horizontal seat portion of the support and the upper portion of the sheet forming an upright or inclined back portion of the support.

17. The method of claim 16 wherein parts (A), (B), and (C) are performed with the person sitting upright on the lower portion of the sheet facing the lower edge of the sheet with the upper portion of the sheet behind the person, and with the frame straddling the legs or hips of the person.

18. The method of claim 16 further comprising, before part (A), positioning the sheet beneath the person.

19. The method of claim 16 further comprising attaching the upper portion of the frame to a lifting device.

20. The method of claim 16 further comprising using a lifting device to lift the apparatus and the person sitting thereon.

21. The apparatus of claim 1:

(i) the left tube being positioned in the gap between the left sleeves, and the left rod being positioned through the left tube and at least partly within both of the left sleeves;

(ii) the right tube being positioned in the gap between the right sleeves, and the right rod being positioned through the right tube and at least partly within both of the right sleeves;

(iii) the upper portion of the sheet being attached to the upper portion of the frame; and (iv) the sheet forming a support for the person, the lower portion of the sheet forming a horizontal seat portion of the support and the upper portion of the sheet forming an upright or inclined back portion of the support.

22. The apparatus of claim 21 further comprising one or more restraint members attached to one or both of the sheet or the frame and structurally arranged so as to obstruct movement of the person, while seated on the support, off of the support.

23. A method employing the apparatus of claim 21, the method comprising:

(A) with the person sitting upright on the support, detaching the upper portion of the sheet from the upper portion of the frame;

(B) removing the left rod from one or both of the left sleeves and from the left tube, and removing the right rod from one or both of the right sleeves and from the right tube; and (C) removing the left tube from the gap between the left sleeves, removing the right tube from the gap between the right sleeves, and removing the frame from a position straddling the legs or hips of the person.

24. The method of claim 23 further comprising, after part (C), removing the sheet from beneath the person.

25. A method employing the apparatus of claim 21, the method comprising:

(A) with a person sitting upright on the support, using a lifting device to lift the apparatus and the person sitting thereon;

(B) with the lifting device supporting the apparatus and the person sitting thereon, moving the lifting device to a different location; and (C) using the lifting device to lower the apparatus and the person sitting thereon onto a seat or bed.

26. The method of claim 25 further comprising, before part (A), attaching the lifting device to the upper portion of the frame.

27. The method of claim 25 further comprising, after part (C), detaching the lifting device from the upper portion of the frame.

* * * * *